United States Patent [19]

Verolme

[11] 4,083,318

[45] Apr. 11, 1978

[54] LNG TANKER

[75] Inventor: Cornelis Verolme, Ridderkerk, Netherlands

[73] Assignee: Naval Project Development Sarl, Luxemburg, Luxembourg

[21] Appl. No.: 762,132

[22] Filed: Jan. 24, 1977

[30] Foreign Application Priority Data

Feb. 3, 1976 Netherlands ..... 7601076

[51] Int. Cl.[2] ..... B63B 25/98

[52] U.S. Cl. ..... 114/74 A; 114/75; 220/445

[58] Field of Search ..... 114/74 A, 74 R, 75; 220/9 A, 9 LG, 15

[56] References Cited

U.S. PATENT DOCUMENTS

| | | | |
|---|---|---|---|
| 2,537,085 | 1/1951 | Phelps | 114/74 A |
| 2,600,015 | 6/1952 | McLaughlin | 114/74 A |
| 3,145,680 | 8/1964 | Farkas et al. | 114/74 A |
| 3,270,700 | 9/1966 | Kohn et al. | 220/9 LG |
| 3,411,658 | 11/1968 | Swanson | 220/15 |
| 3,537,416 | 11/1970 | Cowles | 114/74 A |
| 3,937,353 | 2/1976 | Becker et al. | 114/74 A |

*Primary Examiner*—Trygve M. Blix
*Assistant Examiner*—Stuart M. Goldstein
*Attorney, Agent, or Firm*—Strauch, Nolan, Neale, Nies & Kurz

[57] ABSTRACT

A tanker for the storage and transport of liquified gas at low temperatures which includes a plurality of vessels arranged in an insulated hold in a vertical orientation and in an optimum space utilization pattern. The vessels have a cylindrical or prismatic configuration and a diameter-height ratio of about 1:2 to 1:5 and preferably of from 1:2.5 to 1:3.5. The vessels are arranged in spaced relationship and are interconnected exclusively at their upper and lower ends into one pack extending over the full width of the hold. The pack of vessels has at its center means acting on the bottom of the hold to position the pack horizontally.

8 Claims, 1 Drawing Figure

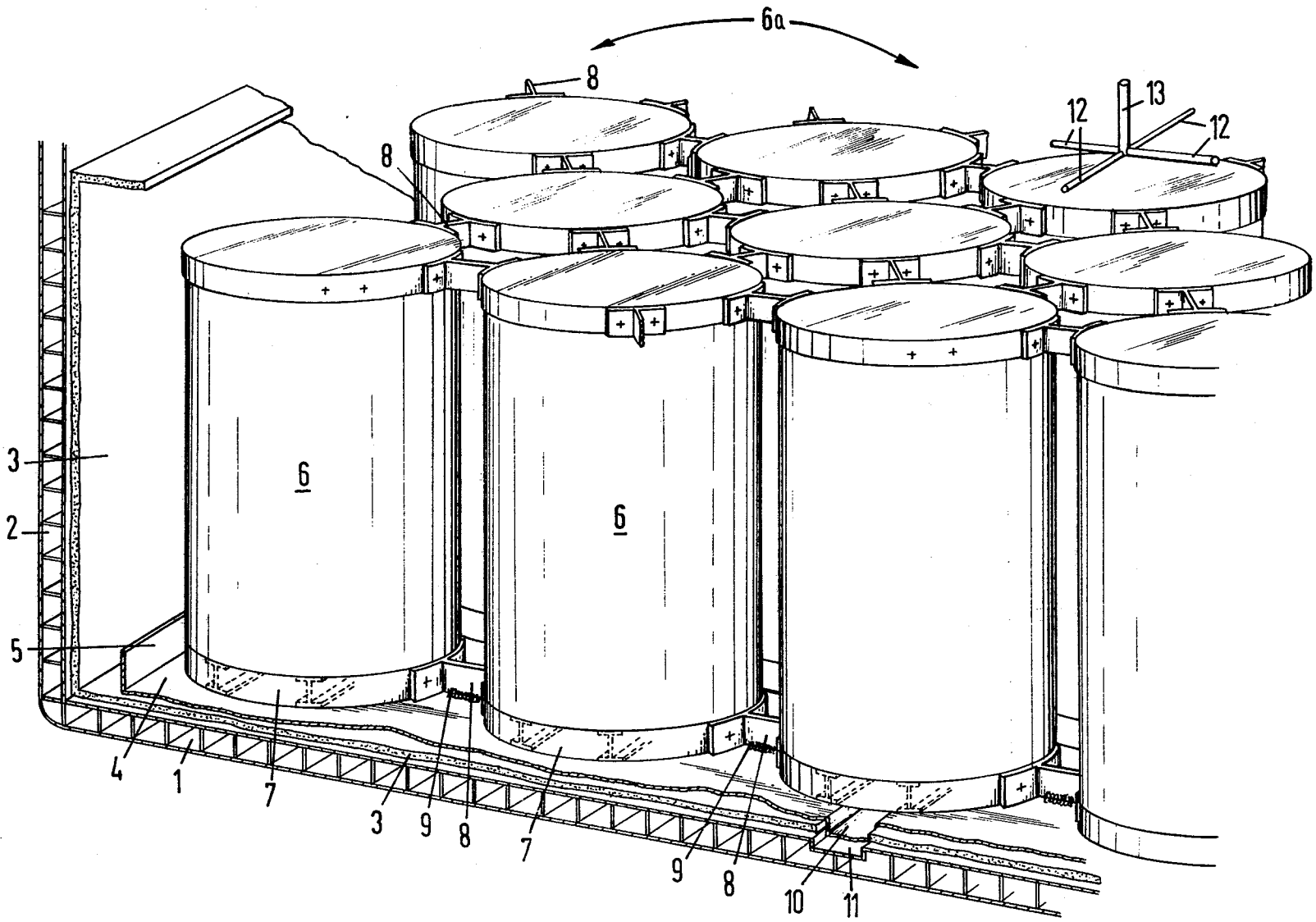
6a
8
12
13
12
8
6
6
3
2
5
4
1
7
3
9
8
7
9
8
10
11

LNG TANKER

This invention relates to the storage and transport of liquified gas and, in particular, to a LNG tanker having a plurality of cylindrical vessels arranged in a thermally insulated hold in a vertical orientation and in an optimally effective space-filling pattern.

In prior designs of this type use is often made of vessels or containers in the form of relatively long, thin "bottles" having a diameter-length ratio exceeding 1:10, for example 1:15, which means that with a hold 30 meters high the containers have a diameter of 3 meters or less.

Particularly with LNG tankers of great capacity—that is, on the order of tankers for the transport of crude oil, which may exceed 100,000 tons and even have a capacity of 400,000 tons—this results in a very large number of vessels. Each of these has to be fixed while allowing for thermal expansion and shrinkage. Also, the connecting pipe systems become extremely complicated, many bends and bellows constructions being needed to compensate for differential expansions.

Besides, such tall, thin vessels quite adversely influence the degree to which the hold can be filled because it is desirable and often required that each vessel be accessible from all sides for inspection purposes.

A number of the above-mentioned drawbacks do not exist in LNG tankers of the type in which use is made of large, rectangular cryogenic storage tanks substantially corresponding to the hold configuration. However, with large ships of capacities up to 400,000 cubic meters, the construction of such tanks presents as yet insurmountable problems.

Therefore, the primary object of the invention is to provide a LNG tanker of the type described above and with great capacity; i.e., exceeding 100,000 cubic meters, and, for example 4000,000 cubic meters, while avoiding the drawbacks mentioned earlier.

To this end the containers or vessels according to the invention are constructed as cylinders or with a prismatic configuration and with a diameter-height ratio of about 1:2 to 1:5 and preferably from 1:2.5 to 1:3.5. These vessels are arranged in spaced relationship and are interconnected exclusively by connecting pieces at the covers and at the flat bottom by support structures to form one pack extending over the full width of the hold. This pack of vessels is anchored solely with respect to the bottom of the hold and is provided in its center with horizontal positioning means acting on the bottom of the hold.

Such a pack of vessels extending over the full width and possibly the entire length of the hold and having the above-mentioned diameter-height ratio and a space of about 0.5 meters around each vessel for inspection purposes can more completely fill a hold than a pack of vessels having a conventional diameter-height ratio of, for example, 1:15.

Moreover, in view of the height-width ratio thereof the stability of the pack is such that support against the ship's walls and/or bulkheads and fixation with respect to the overhead deck construction becomes superfluous. Also, owing to the relatively small number of tanks in the pack, simple pipe systems will suffice. And, by attaching the connecting pieces to the tanks exclusively at the covers and the bottom structures, joining operations such as welding and possible, riveting or bolting, on the tank walls are avoided.

By providing the pack of vessels exclusively with centrally located, horizontally operating, positioning means acting on the bottom of the hold and hence keeping the vessels free from the walls of the hold, it is made possible for thermal expansion of the pack of vessels, which can take place freely in vertical direction since the upper part of the pack is spaced from the deck construction, to also take place freely in radial directions and relative to a central "shrinking point".

A drip-tray may be provided between the pack of vessels and the bottom of the hold. The pack of vessels is fixed in the ship's hold in a horizontal sense while allowing thermal deformations, and any LNG leaking from a vessel can be collected by the drip-tray. The drip-tray is preferably made of the same material as the vessels, for instance aluminium, and, at any rate, from a material having the same coefficient of expansion.

Furthermore, the pipes at the top of the pack of vessels can be arranged in a pattern having interconnections in the region of the "shrinking point".

Owing to the relatively limited number of vessels the pattern of manifolds can be simple and such that, within the pattern of pipes, the thermal movements correspond with the radial, thermal movements of the pack of vessels with respect to the central shrinking point so that the need for bellows and the like can be reduced to a minimum.

One important and primary object of the invention has been identified above.

Other important objects and features and additional advantages of the invention will be apparent from the appended claims and as the ensuing detailed description and discussion proceeds in conjunction with the accompanying drawing in which the single FIGURE is a detailed, partial perspective view looking in the fore-and-aft direction of an arrangement of schematically drawn vessels in a LNG ship's hold, all in accord with the principles of the present invention.

The LNG storage and transporting arrangement shown in the drawing and constructed in accord with the principles of the present invention includes a ship's hold with a double bottom indicated by 1 and a side wall by 2, the latter being thermally insulated with insulating material 3. A tray 4 having upright side walls 5 extends over substantially the full width of the hold. Tray 4 is a so-called drip-tray; it collects any LNG leaking from the containers.

On tray 4 is a plurality of LNG containers or vessels 6 having a diameter-height ratio of 1:2 to 1:5 and preferably of from 1:2.5 to 1:3.5. Exemplary containers will have, for example, a height of about 30 meters with a diameter of about 12 meters.

Each vessel 6 rests on a schematically shown bottom support 7 and is connected to adjacent vessels 6 by I-shaped connecting pieces 8 at both the upper and lower ends of the containers. This maintains a spacing which keeps the tanks accessible for inspection from all sides. In actual practice the spacing need not be more than about 0.5 meters; but, for the sake of clearness, the tanks are shown at a greater distance. Also, the height-diameter ratio is not to scale.

The pack **6*a* of vessels 6 formed as just described can be connected to drip-tray 4 by welding those connecting pieces 8 located along the centerline of pack 6*a* to the tray as indicated by reference characters 9**.

Drip-tray 4 has one or more recesses 10 located in corresponding trough-shaped recesses 11 in the double bottom 1 of the hold. The recesses 11 in the tanker bottom may include a central longitudinal trough as shown and one or more transverse troughs (not shown) intersecting the longitudinal trough.

By virtue of the mounting arrangement just described the pack 6*a* of vessels 6 in the hold of the tanker is and remains secured against lateral displacements but is free from side walls 2, any bulkheads in the hold, and insulating layers 3.

The pack 6*a* of vessels is free to expand and shrink vertically as it is not connected to the deck construction at its upper end. Horizontal expansion and contraction is also possible because the containers are spaced from the side walls of the hold and also from bulkheads, if any. Such horizontal movements of each pack 6 will take place relative to a "central shrinking point", which will substantially coincide with the intersection of trough 11 and a transverse trough (not shown), if any.

Also, by virtue of claimed arrangement, the pack of LNG containers 6 can be constructed so that pack 6 and the bottom wall 1 of the hold will deflect along substantially congruent lines as stresses are transferred from containers 6 to the bottom wall. This minimizes the damage that would otherwise result from differential deflections of the container and the bottom wall of the hold.

Owing to the relatively large diameter of vessels 6 compared to their height, only a relatively small number thereof will be present in each hold. This means that the system of pipes for filling and emptying the vessels is relatively simple. In this way it is possible, as is shown diagrammatically in the drawing, for all groups of lines 12 to meet over a pack of vessels 6 at a central point substantially above the abovementioned "shrinking point". The thermally induced expansions and contractions in lines 12 will correspond with those of the pack of vessels 6 making bellows and other devices for accommodating expansion and contraction minimal or even entirely unnecessary.

Also, the number of lines 13 leading upwardly through the deck above the hold (not shown) can be reduced to a mumimum by the illustrated arrangement.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A tanker for storing and transporting a liquified gas at low temperature, said tanker comprising: a thermally insulated hold with side, bottom, and top wall means; a plurality of liquified gas containers arranged in said hold in a vertical orientation and in an optimized, space utilization pattern, said containers having a cylindrical or prismatic configuration and a diameter-height ratio in the range of about 1:2 to 1:5; means interconnecting said vessels solely at the tops and bottoms thereof into one pack spanning substantially the full width of the hold, said interconnecting means being free of contact with the side and top wall means of said hold; and co-acting stop means at the lower ends of the containers and at the bottom of the hold to keep said containers from shifting laterally in said hold, said co-acting stop means being located exclusively at the center of the pack and furnishing the sole interconnection between the containers and the hold.

2. A tanker according to claim 1, in which the height-diameter ratio of the containers is in the range of 1:2.5 to 1:3.5.

3. A tanker according to claim 1, wherein the diameter of the containers exceeds 7 meters.

4. A tanker according to claim 3, in which the diameter of the containers is on the order of 12 meters.

5. A tanker according to claim 1, wherein there are means supporting said containers from the bottom of said hold and co-operable with said co-acting stop means to transfer forces imposed on said containers solely to the bottom of the hold.

6. A tanker according to claim 1, wherein there are means supporting said containers from the bottom of said hold and co-operable with said co-acting stop means to transfer horizontal forces imposed on the containers only to the bottom of the hold by way of the co-acting stop means.

7. A tanker according to claim 6, wherein the co-acting stop means are physically affixed to the bottom wall of the hold.

8. A tanker according to claim 7, together with means so supporting the containers from the bottom wall of the hold and so co-operating with the co-acting stop means that deflections of said pack result in essentially congruent deflections of the bottom wall of the hold.

* * * * *